US005961112A

United States Patent [19]

Kim

[11] Patent Number: 5,961,112

[45] Date of Patent: Oct. 5, 1999

[54] PAPER FEEDING UNIT DRIVING DEVICE FOR ELECTROPHOTOGRAPHIC PROCESSOR

[75] Inventor: Woo-Seog Kim, Seoul, Rep. of Korea

[73] Assignee: SamSung Electronics Co., Ltd., Kyungki-do, Rep. of Korea

[21] Appl. No.: 08/751,704

[22] Filed: Nov. 18, 1996

[30] Foreign Application Priority Data

Nov. 17, 1995 [KR] Rep. of Korea ..... 95-41883

[51] Int. Cl.[6] ..... B65H 5/00

[52] U.S. Cl. ..... 271/10.05; 271/10.12; 271/10.13; 271/116; 271/242

[58] Field of Search ..... 271/4.08, 4.1, 271/10.04, 10.09, 10.11, 10.12, 10.13, 16, 21, 116, 242, 10.05

[56] References Cited

U.S. PATENT DOCUMENTS

| | | | |
|---|---|---|---|
| 3,100,111 | 8/1963 | Elchorn et al. . | |
| 3,137,495 | 6/1964 | Elchorn . | |
| 3,294,019 | 12/1966 | Taylor . | |
| 3,545,743 | 12/1970 | Limberger . | |
| 4,438,915 | 3/1984 | Akamatsu et al. . | |
| 4,516,764 | 5/1985 | Tamura . | |
| 4,529,188 | 7/1985 | Sturnick . | |
| 5,141,217 | 8/1992 | Lim et al. | 271/10.13 |
| 5,203,553 | 4/1993 | Chiang | 271/116 |
| 5,240,242 | 8/1993 | Ando et al. | 271/116 |
| 5,435,537 | 7/1995 | Namiki | 271/116 |

FOREIGN PATENT DOCUMENTS

| | | | |
|---|---|---|---|
| 002123811 B2 | 4/1978 | Germany | 271/10.11 |
| 1 603 067 | 11/1981 | United Kingdom . | |
| 2 142 907 | 1/1985 | United Kingdom . | |

*Primary Examiner*—H. Grant Skaggs
*Attorney, Agent, or Firm*—Robert E. Bushnell, Esq.

[57] ABSTRACT

A paper feeding unit driving device for an electrophotographic processor having a feed roller gear and a convey roller gear, a paper feed roller, and a convey roller, includes: a latch having first and second latch lugs and a first elastic member, a first shaft, a first clutch-spring, a first collar, a first stop, and a first hub, a second shaft, a second clutch-spring, a second collar, a second stop, and a cam, and a solenoid having a plunger and a second elastic member.

51 Claims, 5 Drawing Sheets

PAPER FEEDING UNIT DRIVING DEVICE FOR ELECTROPHOTOGRAPHIC PROCESSOR

CLAIM OF PRIORITY

This application make reference to, incorporates the same herein, and claims all benefits accruing under 35 U.S.C §119 from an application entitled PAPER FEEDING UNIT DRIVING DEVICE FOR ELECTROPHOTOGRAPHIC PROCESSOR earlier filed in the Korean Industrial Property Office on Nov. 17, 1995 and assigned Ser. No. 41883/1995.

BACKGROUND OF THE INVENTION

1. Field of the Invention

The present invention relates to an electrophotographic processor such as a printer, a photocopier, a facsimile machine using plain paper, etc and more particularly, to a paper feeding unit driving device for an electrophotographic processor that can drive a convey roller and a paper feeding roller with one solenoid.

2. Description of the Related Art

U.S. Pat. No. 4,529,188 to Sternick discloses a paper feeding unit driving device having one solenoid, a pair of spring-clutches, arms and a lever. The following description, including FIGS. 1–2B, concerns the operation of the apparatus of U.S. Pat. No. 4,529,188.

As shown in FIG. 1, the drive assembly includes gears 98 and 88 for providing positive drive capability from the main machine drive to both a feed roller shaft and a convey roller shaft. On one side of the gear 88 there are formed a convey roller 84 for providing a copy paper to an image forming unit and a shaft 86 for transmitting the positive drive capability of the gear 88 to the convey roller 84. A wrap spring 90 for controlling the rotation of the shaft 86 is provided on the other side of the gear 88, and exterior of the wrap spring is a collar 94 for connecting the gear 88 and a hub 96 to each other. The collar 94 is provided with a plurality of stops on its cylindrical surface for engagement with one end of a control actuator arm 110 to interrupt the rotational motion of the convey roller 84, and an output hub 96 connected to one side of the collar 94 is fixed to the shaft 86.

On one side of the gear 98 there are formed segmented feed rollers 80 for providing a copy paper contained in a paper cassette to the convey roller 84 and a shaft 82 for transmitting the positive drive capability of the gear 98 to the segmented feed rollers 80. A wrap spring 100 for controlling the rotation of the shaft 82 is provided on the other side of the gear 98, and exterior of the wrap spring is a collar 102 for connecting the gear 98 and a cam 108 to each other. The collar 102 is provided with a stop 104 on its inboard surface for engagement with the other end of control actuator arm 110 to interrupt the rotational motion of the convey roller 84, and has a stop 106 for engagement with the other end of control actuator arm 110 to interrupt the rotational motion of the segmented feed rollers 80. The cam 108 that comes into contact with a lever 112 to actuate the control actuator arm 110 upward and downward is provided on one side of the collar 102. The control actuator arm 110 and the cam 108 are connected to each other by a spring 114 to actuate by the retraction thereof. A hub that is provided on one side of the cam 108 is fixed to one end of the shaft 82. Under the gears 88 and 98, the control actuator arm 110 is formed to cut off the rotational motion of the segmented feed rollers 80. The lever 112 and the control actuator arm 110 are fixed to the frame by a control arm pivot 120. The lower section of the control actuator arm 110 is provided with solenoid 116 for actuating the control actuator arm 110 to transmit a drive to the segmented feed rollers 80 and the convey roller 84. A plunger 118 is formed on the solenoid 116 and connected to the end of the control actuator arm 110 to actuate the control actuator arm 110 upward and downward.

Referring to FIGS. 2A and 2B, the gear 88 is rotated counterclockwise by the drive of the main motor, and the gear 98 is rotated clockwise. When the solenoid 116 is energized, the segmented feed rollers 80 are driven in a direction to feed a copy paper through the nip. The cam 108 is rotated clockwise, and the stop 106 provided on one side of the cam 108 comes into contact with one end of the control actuator arm 110 to cut off the drive that is transmitted to the segmented feed rollers 80. The segmented feed rollers 80 then stop their rotation, and the convey roller 84 is energized to convey the paper to the image forming unit.

The cam 108 continues rotating to contact the stop 104 and one end of the control actuator arm 110. The lever 112, having one end which rides on the cam surface, comes into contact with the upper dead point of the cam 108, and simultaneously with this, the other end of the control actuator arm 110 is engaged with one of the stops 92 to cut off the drive that is transmitted to the convey roller 84. The lever 112 and the control actuator arm 110 are connected to each other by the spring 114 to actuate by the retraction thereof.

As the cam 108 keeps rotating, the lever 112 is placed on the upper dead point of the cam 108, and the other end of the control actuator arm 110 is engaged with one of the stops 92 of the collar 94. At the same time, the segmented feed rollers 80 are rotated in a direction to feed the paper to the convey roller 84. The solenoid 116 keeps its energized force until the control actuator arm 110 is engaged with one the stops 92.

The solenoid 116 keeps on being energized from the paper delivery of the segmented feed rollers 80 to the paper delivery of the convey roller 84 to the image forming unit, which may reduce the life of the solenoid 116. In addition, the long turned-on state of the solenoid 116 requires more energy, and the lever 112 and the control arm 110 become connected with each other by the spring 114 and control the mutual actuation to demand the precise action of the spring. The use of the lever 112 and the spring 114 causes an increase in the number of components and production cost, and makes the structure complex so as to have a disadvantageous yield.

The following additional patents have features in common with the present invention, but nevertheless do not teach or suggest the specifically recited arrangement of the present invention.

- U.S. Pat. No. 4,516,764 to Tamura entitled Paper Feeding Device.
- U.S. Pat. No. 4,438,915 to Akamatsu, et al. entitled Sheet Feeding Device.
- U.S. Pat. No. 3,545,743 to Limberger entitled Apparatus for Drawing in Templates into a Processing Device, More particularly for Copying Machines and the Like.
- U.S. Pat. No. 3,294,019 to Taylor entitled Rotary Printing Machine.
- U.S. Pat. No. 3,100,111 to Elchorn, et al. entitled Sheet Feeding Machine.
- U.S. Pat. No. 3,137,495 to Elchorn entitled Sheeting Feeding Mechanism.

SUMMARY OF THE INVENTION

Accordingly, it is an object of the present invention to provide a paper feeding unit driving device for an electrophotographic processor with a low number of components that can reduce the production cost.

It is an another object of the present invention to provide a paper feeding unit driving device in which a solenoid is energized until a paper feed roller feeds a copy paper through the registration nip.

It is a further another object of the present invention to provide a highly reliable and accurate paper feeding unit driving device.

It is a still another object of the present invention to provide a paper feeding unit driving device with a low number of components which are easy to make and easy to assemble in a modular form.

It is a still further another object of the present invention to provide a paper feeding unit driving device in which the solenoid's life can be extended.

To achieve these and other objects, the inventive paper feeding unit driving device has a feed roller gear and a convey roller gear rotating by a positive drive of a main motor, a paper feed roller for providing paper stored in a paper cassette to a convey roller, and the convey roller for delivering the paper to an image forming unit, including a latch for the connection and disconnection of a positive drive to be sent to the convey roller and the paper feed roller. The latch has a first latch lug formed on one side thereof to restrict the rotational motion of the convey roller, a second latch lug formed on another side thereof to restrict the rotational motion of the paper feed roller, and a first elastic member for applying a resilient force when the latch is actuated.

A first shaft is provided on one side of the convey roller gear to supply the drive of the convey roller gear to the convey roller; a first clutch-spring is provided on the other side of the registration roller gear to control the operation of the first shaft; a first collar is provided on one side of the first clutch-spring to link the convey roller gear and a first hub together; a first stop is formed on the cylindrical surface of the first collar and is engaged with the first latch lug to interrupt the rotational motion of the convey roller, and a first hub is provided on one side of the first collar to be fixed to one end of the first shaft.

The paper feeding unit driving device also includes a second shaft for supplying the drive of the feed roller gear to the paper feed roller, a second clutch-spring for controlling the rotational motion of the second shaft, a second collar provided on one side of the second clutch-spring to connect the feed roller gear and a second hub together, a second stop formed on the cylindrical surface of the second collar to interrupt the rotational motion of the paper feed roller, the second hub being fixed to one end of the second shaft, and a cam formed on one side of the second hub to be engaged with the second latch protrusion to transmit the drive to the convey roller; and a solenoid for transmitting the drive to the paper feed roller, the solenoid having a plunger disposed on the solenoid so as to be engaged with the second stop to interrupt the rotational motion of the paper feed roller and a second elastic means for causing the plunger to move to its original unenergized state.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

A preferred embodiment of the present invention is now described in detail with reference to the accompanying drawings.

Figure 1:
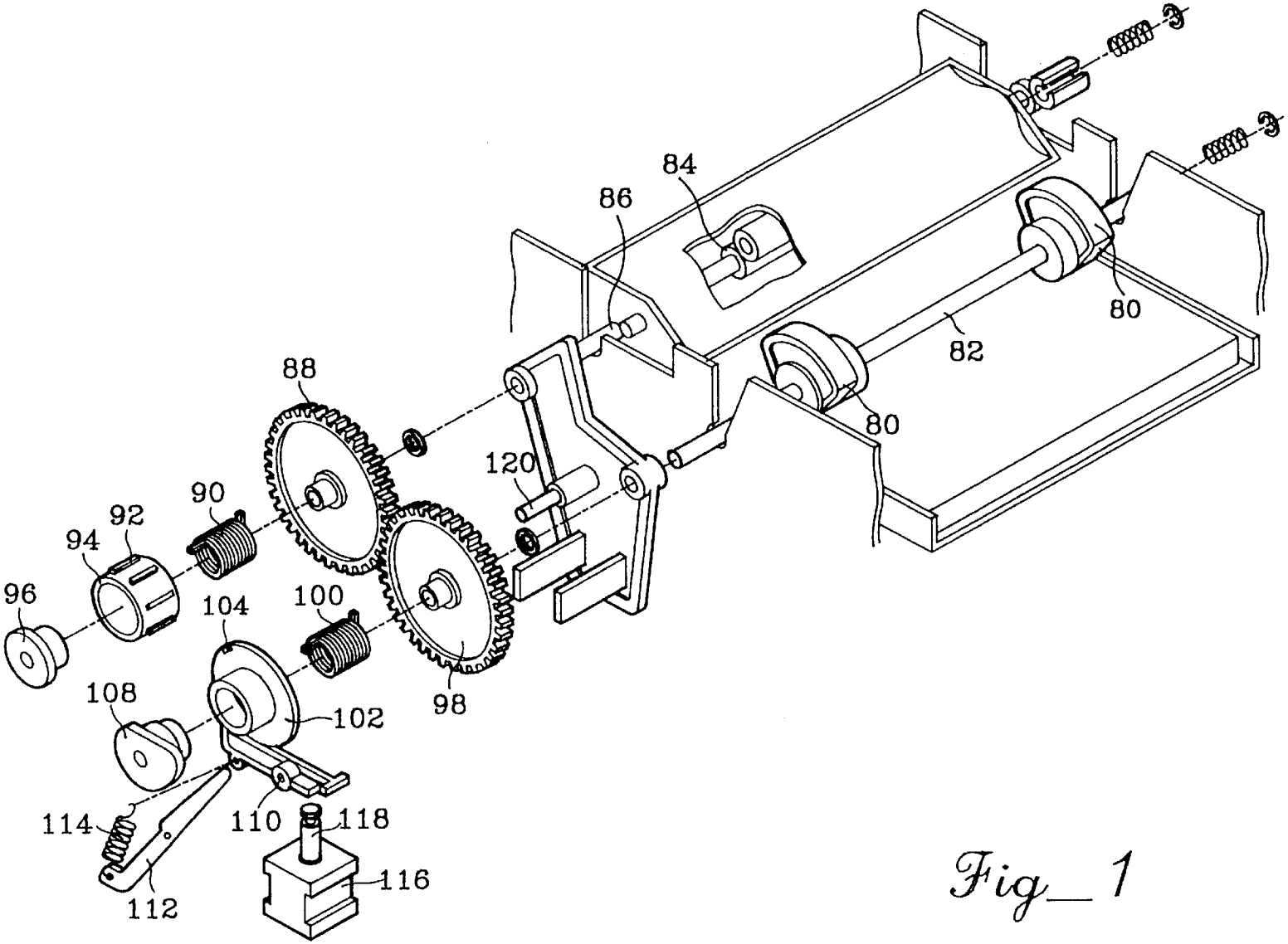
FIG. 1 is an exploded view of an earlier paper feeding unit driving device for an electrophotographic processor.
Figure 2A:
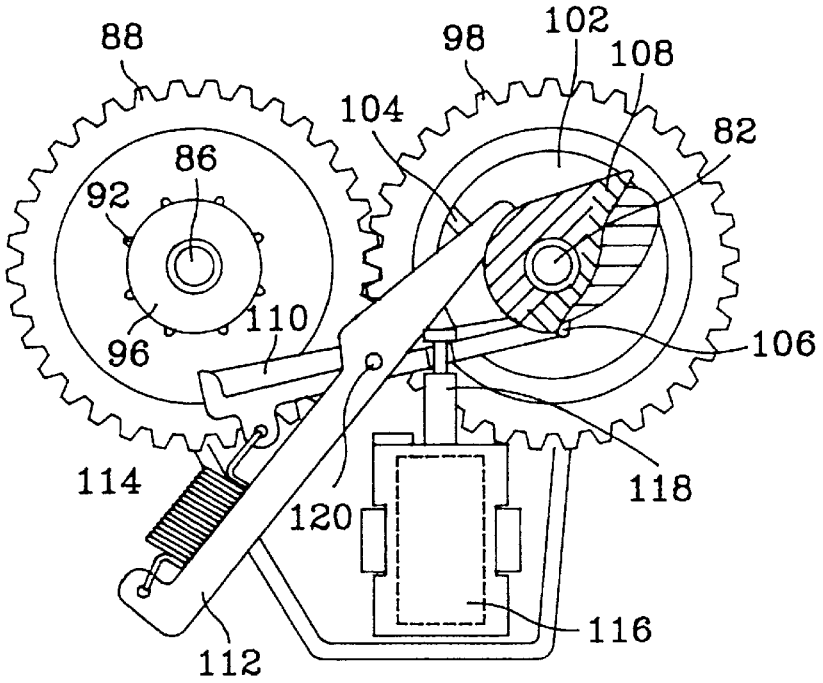
FIGS. 2A and 2B are schematic diagrams of the operation of the earlier paper feeding unit driving device.
Figure 2B:
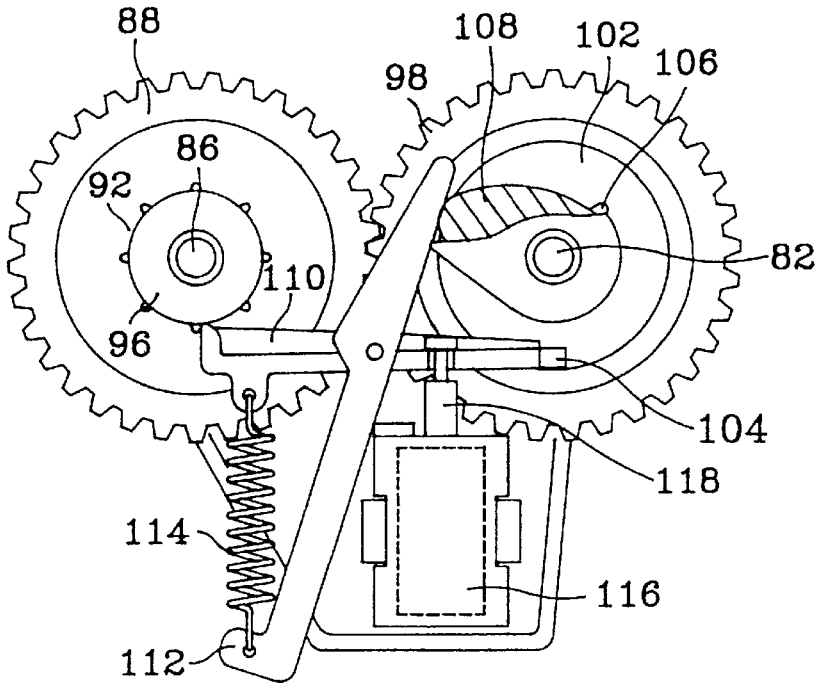
Figure 3:
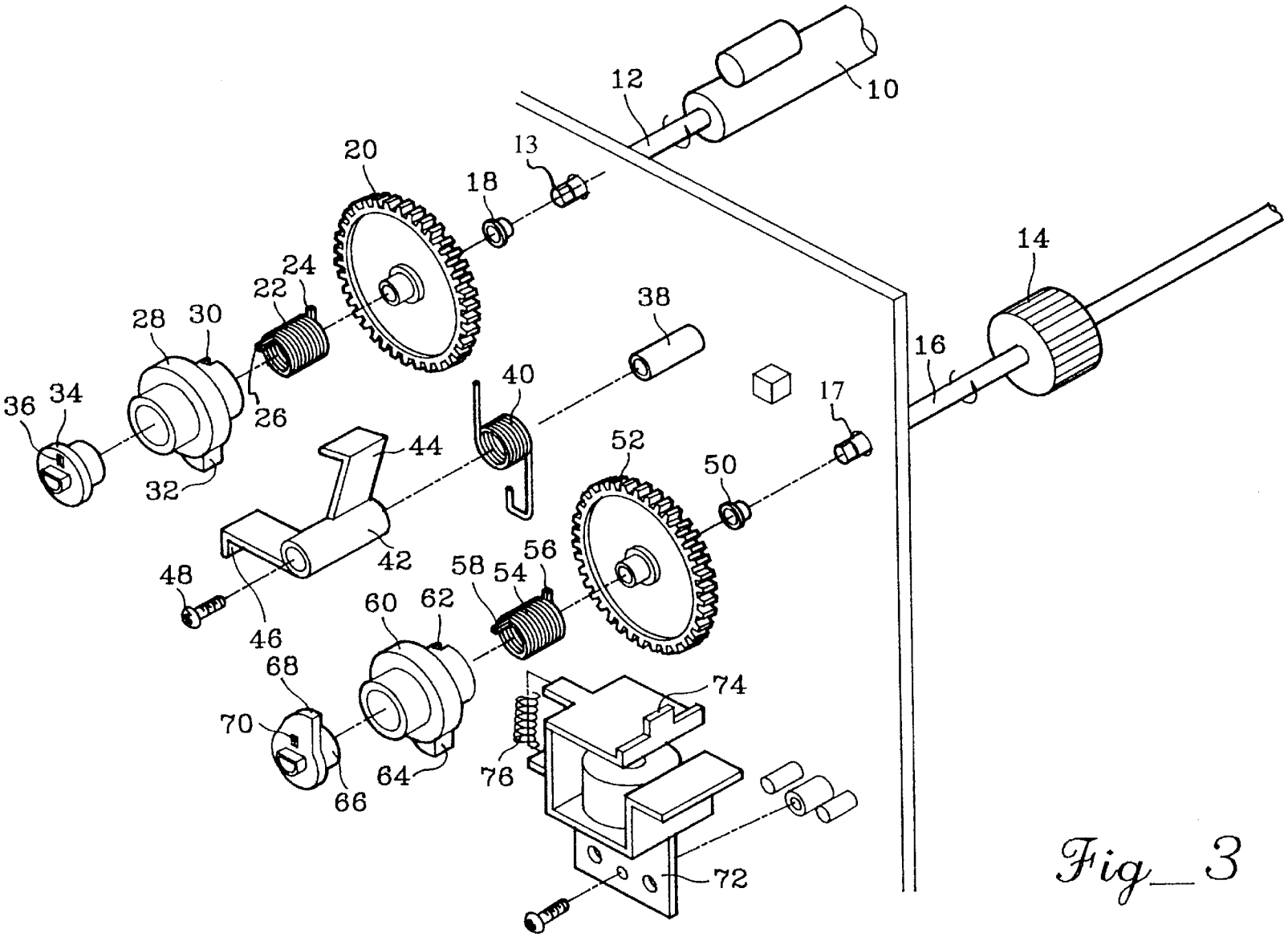
FIG. 3 is an exploded view of a paper feeding unit driving device of an electrophotographic processor in accordance with the present invention.
Figure 4A:
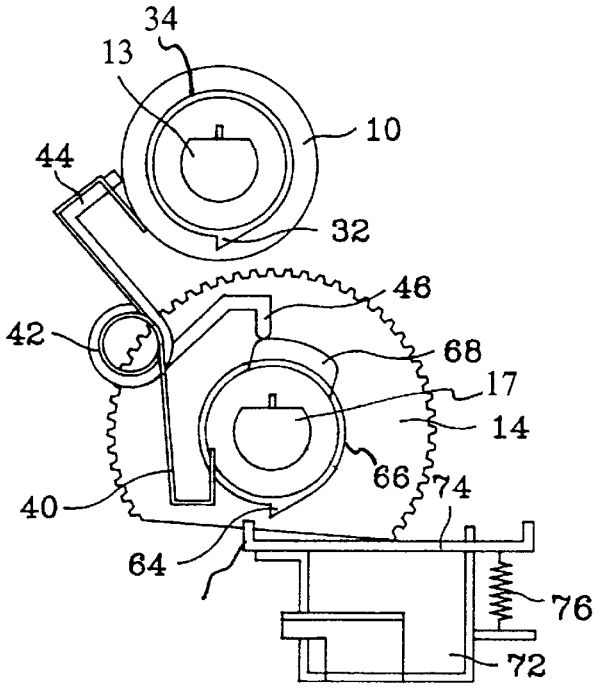
FIGS. 4A, 4B, 4C and 4D are schematic diagrams of the operation of the inventive paper feeding unit driving device.
Figure 4B:
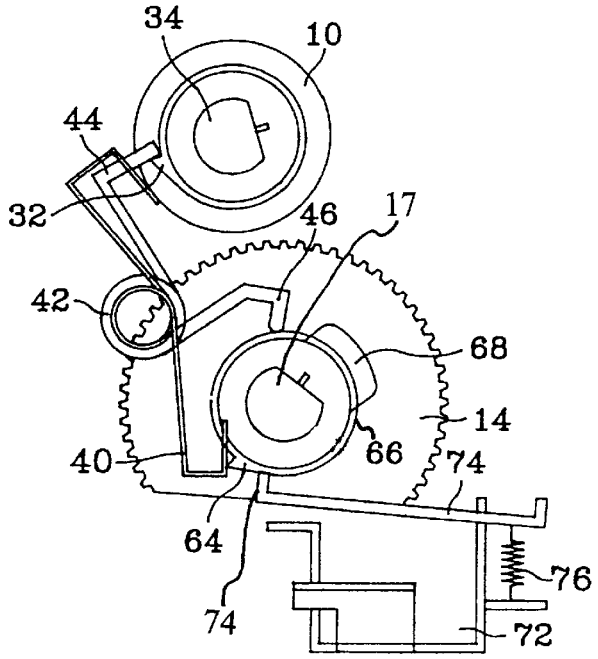
Figure 4C:
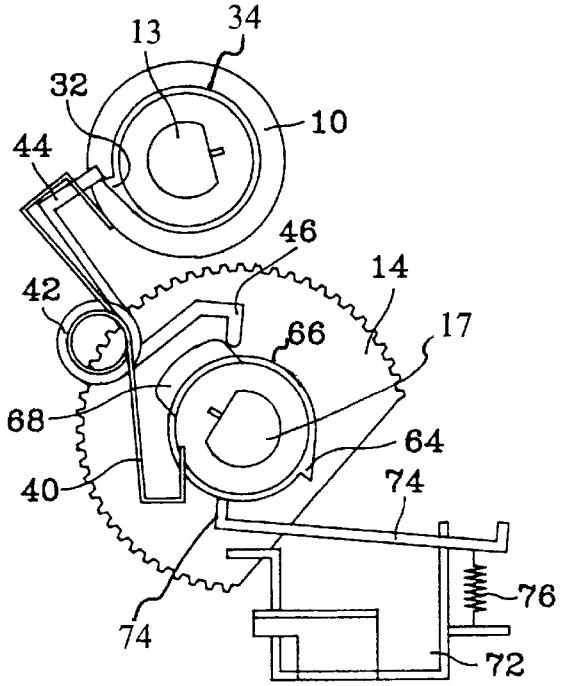
Figure 4D:
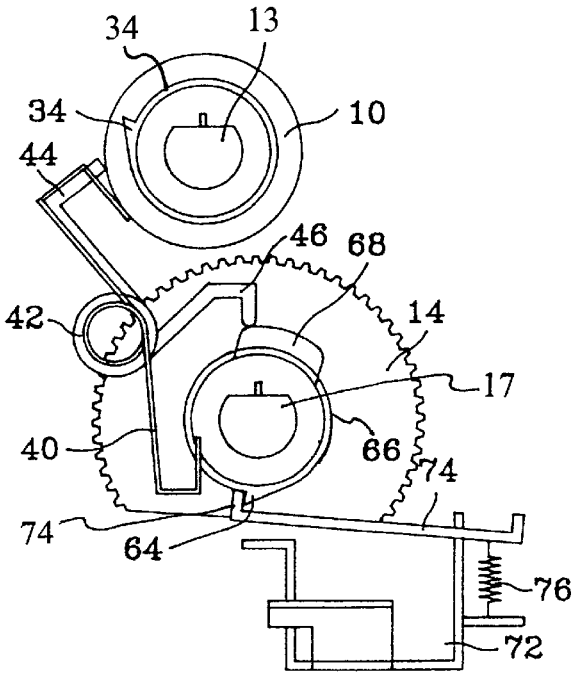

Referring to FIG. 3, a paper feeding unit driving device of an electrophotographic processor includes a feed roller gear 52 and a convey roller gear 20 that rotate by a positive drive of a main motor, a paper feed roller 14 for providing paper stored in a paper cassette to a convey roller 10, and the convey roller 10 for delivering the paper to an image-forming unit.

The apparatus also includes a latch 42 for the connection and disconnection of a positive drive to be sent to the convey roller 10 and paper feed roller 14, a first bracket-shaped latch lug 44 formed on one side of the latch 42 to restrict the rotational motion of the convey roller 10, and a second bracket-shaped latch lug 46 formed on the other side of the latch 42 to restrict the rotational motion of the paper feed roller 14. Exterior of the latch 42 is an elastic member 40 that is a torsion spring for applying a resilient force when the latch 42 is actuated.

One side of the convey roller gear 20 is provided with a first shaft 12 having a D-cut end 13 to supply the drive of the convey roller gear 20 to the convey roller 10, and a first bushing 18 to prevent the abrasion of the first shaft 12. The other side of the convey roller gear 20 is provided with a first clutch-spring 22 to control the operation of the first shaft 12. One side of the first clutch-spring 22 is provided with a first collar 28 to link the convey roller gear 20 and a first hub 34 together; the first collar 28 has a first opening 30 into which a first projection 24 formed on one side of the first clutch-spring 22 is inserted so as to cause them to turn together. The first collar 28 has a first stop 32 on its cylindrical surface that is engaged with the first latch lug 44 to interrupt the rotational motion of the convey roller 10. The first hub 34 with a D-cut central portion is provided on one side of the first collar 28 so as to be fixed to one end 13 of the first shaft 12.

The first hub 34 has a first hole 36 into which a second projection 26 provided on the other side of the first clutch-spring 22 is received. A second shaft 16 having a D-cut end 17 is formed to supply the drive of the feed roller gear 52 to the paper feed roller 14, and a second bushing 50 for preventing the abrasion of the second shaft 16 is provided on one side of the feed roller gear 52. A second clutch-spring 54 is provided on the other side of the feed roller gear 52 to control the rotational motion of the second shaft 16, and a second collar 60 is provided on one side of the second clutch-spring 54 to connect the feed roller gear 52 and a second hub 66 together. The second collar 60 has a second opening 62 into which a third projection 56 of the second clutch-spring 54 is inserted.

A second stop 64 that interrupts the rotational motion of the paper feed roller 14 is formed on the cylindrical surface of the second collar 60; the second hub 66, which is fixed to one end of the second shaft 16, is provided on one side of the second collar 60. The second hub 66 has a D-cut central portion into which the second shaft 16 is inserted, and the second hub 66 has a second hole 70 on its inboard surface into which a fourth projection 58 of the second clutch-spring 54 is inserted. The second hub 66 has a cam 68 that is engaged with the second latch protrusion 46 to transmit the drive to the convey roller 10. A solenoid 72 is disposed under the second collar 60 to transmit the drive to the paper feed roller 14, and the solenoid 72 only controls the rotation of the paper feed roller 14 and not the convey roller 10.

When the solenoid 72 is energized, a plunger 74 is moved downward to be separated from the second stop 64, and, almost simultaneously with this, the solenoid 72 is deenergized so that the plunger 74, formed on the solenoid 72 and engaged with the second stop 64 to interrupt the rotational motion of the paper feed roller 14, recovers its basic position by a second elastic member 76. This second elastic member 76 is a coil spring which is installed on one side of the solenoid 72 in order for the plunger 74 to return to its original unenergized position.

As shown in FIGS. 3, 4A, 4B, 4C and 4D, the convey roller gear 20 and the feed roller gear 52 are rotated by the drive of the main motor. When the solenoid 72 is energized, the second stop 64 engaged with the plunger 74 becomes separated therefrom, and the drive of the feed roller gear 52 is transmitted to the paper feed roller 14 to let the paper feed roller 14 rotate and feed the paper to the convey roller 10. The second stop 64 and the plunger 74 are separated from each others against the compression force of the second elastic member 76. Shortly thereafter, the solenoid 72 is turned off, and the plunger 74 of the solenoid 72 returns to its original unenergized state by the retraction of the second elastic member 76. The second latch lug 46 contacting the upper dead point of the cam 68 is moved to the bottom dead point of the cam 68. The first latch lug 44 of the latch 42 becomes engaged with the first stop 32 formed on the cylindrical surface of the first collar 28 to shut off the drive transmitted to the convey roller 10.

Subsequently, when a predetermined-sized curl is generated to force the lead edge of the paper into contact with the one surface of the convey roller 10 that stops its rotation so as to provide paper alignment, the second latch lug 46 provided on the lower section of the latch 42 is moved again to the upper dead point of the cam 68 followed by cut off of the drive transmitted to the paper feed roller 14. Simultaneously with this, the first latch lug 44 becomes separated from the first stop 32 so that the rotational motion of the convey roller gear 20 is applied to the convey roller 10 to feed the paper to the image forming unit. Successive sheets of paper are fed to the image forming unit through the above-mentioned steps.

The inventive paper feeding unit driving device for an electrophotographic processor does not employ a spring and a lever that are used for conventional systems to control the drive, and obtains advantages of the simplification of structure, reduction in overall production costs, and increase in productivity. Besides, since the solenoid of the inventive apparatus can be instantly energized at the time when the paper feed roller feeds the paper to the convey roller, there is no need to apply a powerful force to the solenoid, thereby extending the life of the solenoid. Thus, the present invention having a relatively low number of components which are easy to make and easy to assemble in a modular form, provides a highly reliable and compact paper feeding unit driving device.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A paper feeding unit driving device for an electrophotographic processor having a feed roller gear and a convey roller gear rotating by a positive drive of a main motor, a paper feed roller for providing paper stored in a paper cassette to a convey roller, said convey roller delivering the paper to an image-forming unit, said device comprising:

a latch for selectively allowing the connection and disconnection of a positive drive to be sent to the convey roller in coordination with the paper feed roller in accordance with the orientation of said latch, said latch having a first latch lug formed on one side thereof to restrict the rotational motion of the convey roller, a second latch lug formed on another side thereof to follow the rotational motion of the paper feed roller, and a first elastic means for applying a resilient force when the latch is actuated;

a first shaft provided on one side of the convey roller gear for supplying the drive of the convey roller gear to the convey roller, a first clutch-spring provided on another side of the convey roller gear to control the operation of the first shaft, a first collar provided on one side of said first clutch-spring to connect the convey roller gear and a first hub together via said first clutch-spring, a first stop formed on the cylindrical surface of said first collar and engaged with the first latch lug to interrupt the rotational motion of the convey roller, and said first hub being provided on one side of the first collar to be fixed to one end of the first shaft;

a second shaft for supplying the drive of the feed roller gear to the paper feed roller, a second clutch-spring for controlling the rotational motion of the second shaft, a second collar provided on one side of the second clutch-spring to connect the feed roller gear and a second hub together via said second clutch-spring, a second stop formed on the cylindrical surface of the second collar to interrupt the rotational motion of the paper feed roller, said second hub fixed to one end of the second shaft, and a cam formed on one side of the second hub to be engaged with the second latch lug to regulate transmission of the drive to the convey roller by controlling said orientation; and a solenoid controlling transmission of the drive to the paper feed roller, said solenoid having a plunger to be engaged with the second stop to interrupt the rotational motion of the paper feed roller and a second elastic means for causing the plunger to return to an original unenergized state.

2. The paper feeding unit driving device as claimed in claim 1, said solenoid only controlling the turned-on or turned-off state of the paper feed roller while failing to control the turned-on or turned-off state of the convey roller.

3. The paper feeding unit driving device as claimed in claim 2, said plunger being moved downward to be separated from the second stop when said solenoid is energized, and said plunger returning to its original unenergized state by the second elastic means upon the solenoid being deenergized.

4. The paper feeding unit driving device as claimed in claim 1, wherein said first latch lug comprises a bracket to be engaged with said first stop.

5. The paper feeding unit driving device as claimed in claim 1, wherein said second latch lug comprises a bracket to be engaged with said cam.

6. The paper feeding unit driving device as claimed in claim 1, said first elastic means being a spring.

7. The paper feeding unit driving device as claimed in claim 6, said spring being a torsion spring.

8. The paper feeding unit driving device as claimed in claim 1, said first shaft having a D-cut end so as to be rotated according to the control of the first clutch-spring.

9. The paper feeding unit driving device as claimed in claim 1, said first collar having a first opening into which a first projection, formed on one end of the first clutch-spring, is inserted to cause them to turn together.

10. The paper feeding unit driving device as claimed in claim 1, said first hub having a D-cut central portion so to be fixed to the first shaft.

11. The paper feeding unit driving device as claimed in claim 1, said first hub having a first opening on its inboard surface into which a second projection, formed on one end of the first clutch-spring, is inserted to cause them to turn together.

12. The paper feeding unit driving device as claimed in claim 1, said second shaft having a D-cut end so as to be rotated according to the control of the second clutch-spring.

13. The paper feeding unit driving device as claimed in claim 1, said second collar having a second opening into which a second projection, formed on one end of the second clutch-spring, is inserted to cause them to turn together.

14. The paper feeding unit driving device as claimed in claim 1, said second hub having a D-cut central portion so to be fixed to the second shaft.

15. The paper feeding unit driving device as claimed in claim 1, said second collar having a second opening on its inboard surface into which a second projection, formed on one end of the second clutch-spring, is inserted to cause them to turn together.

16. The paper feeding unit driving device as claimed in claim 1, said second elastic means being a spring.

17. The paper feeding unit driving device as claimed in claim 16, said spring being a tension spring.

18. A driving device for an apparatus having a first roller gear and a second roller gear rotating by a positive drive of a main motor, a first roller for conveying sheets to a second roller, said second roller delivering the sheets to a predetermined location, said device comprising:

a latch for selectively allowing the connection and disconnection of a positive drive to be sent to the second roller in coordination with the first roller in accordance with the orientation of said latch, said latch having a first latch lug formed on one side thereof to restrict the rotational motion of the second roller, a second latch lug formed on another side thereof to follow the rotational motion of the first roller, and a first elastic means for applying a resilient force when the latch is actuated;

a first shaft provided on one side of the second roller for supplying the drive of the second roller gear to the second roller, a first clutch-spring provided on another side of the second roller gear to control the operation of the first shaft, a first collar provided on one side of said first clutch-spring to connect the second roller gear and a first hub together via said first clutch-spring, a first stop formed on the cylindrical surface of said first collar and engaged with the first latch lug to interrupt the rotational motion of the second roller, and said first hub being provided on one side of the first collar to be fixed to one end of the first shaft;

a second shaft for supplying the drive of the first roller gear to the first roller, a second clutch-spring for controlling the rotational motion of the second shaft, a second collar provided on one side of the second clutch-spring to connect the first roller gear and a second hub together via said second clutch-spring, a second stop formed on the cylindrical surface of the second collar to interrupt the rotational motion of the first feed roller, said second hub fixed to one end of the second shaft, and a cam formed on one side of the second hub to be engaged with the second latch lug to regulate transmission of the drive to the second roller by controlling said orientation; and a solenoid controlling transmission of the drive to the first feed roller, said solenoid having a plunger to be engaged with the second stop to interrupt the rotational motion of the first feed roller and a second elastic means for causing the plunger to return to an original unenergized state.

19. The driving device as claimed in claim 18, said solenoid only controlling the turned-on or turned-off state of the first feed roller while failing to control the turned-on or turned-off state of the second roller.

20. The driving device as claimed in claim 19, said plunger being moved downward to be separated from the second stop when said solenoid is energized, and said plunger returning to its original unenergized state by the second elastic means upon the solenoid being deenergized.

21. The driving device as claimed in claim 18, wherein said first latch lug comprises a bracket to be engaged with said first stop.

22. The driving device as claimed in claim 18, wherein said second latch lug comprises a bracket to be engaged with said cam.

23. The driving device as claimed in claim 18, said first elastic means being a spring.

24. The driving device as claimed in claim 23, said spring being a torsion spring.

25. The driving device as claimed in claim 18, said first shaft having a D-cut end so as to be rotated according to the control of the first clutch-spring.

26. The driving device as claimed in claim 18, said first collar having a first opening into which a first projection, formed on one end of the first clutch-spring, is inserted to cause them to turn together.

27. The driving device as claimed in claim 18, said first hub having a D-cut central portion so to be fixed to the first shaft.

28. The driving device as claimed in claim 18, said first hub having a first opening on it inboard surface into which a second projection, formed on one end of the first clutch-spring, is inserted to cause them to turn together.

29. The driving device as claimed in claim 18, said second shaft having a D-cut end so as to be rotated according to the control of the second clutch-spring.

30. The driving device as claimed in claim 18, said second collar having a second opening into which a second projection, formed on one end of the second clutch-spring, is inserted to cause them to turn together.

31. The driving device as claimed in claim 18, said second hub having a D-cut central portion so to be fixed to the second shaft.

32. The driving device as claimed in claim 18, said second collar having a second opening on its inboard surface into which a second projection, formed on one end of the second clutch-spring, is inserted to cause them to turn together.

33. The driving device as claimed in claim 18, said second elastic means being a spring.

34. The driving device as claimed in claim 33, said spring being a tension spring.

35. In an electrophotographic processor having a feed roller gear and a convey roller gear rotating by a positive drive of a main motor, a paper feed roller for providing paper stored in a paper cassette to a convey roller, said convey roller delivering the paper to an image-forming unit, a paper feeding unit driving device comprising:

a latch for selectively allowing the connection and disconnection of a positive drive to be sent to the convey roller in coordination with the paper feed roller in accordance with the orientation of said latch, said latch including first and second restricting means for respectively restricting the rotational motion of the convey roller and following rotation of the paper feed roller, and a first elastic means for applying a resilient force when the latch is actuated;

a first shaft for supplying the drive of the convey roller gear to the convey roller, a first clutch-spring controlling the operation of the first shaft, a first linking means for connecting the convey roller gear and a first hub together via said first clutch-spring, a first stop formed on said first linking means and engaged with the first restricting means for interrupting the rotational motion of the convey roller, and said first hub being fixed to one end of the first shaft;

a second shaft for supplying the drive of the feed roller gear to the paper feed roller, a second clutch-spring for controlling the rotational motion of the second shaft, a second linking means for connecting the feed roller gear and a second hub together via said second clutch-spring, a second stop formed on said second linking means for interrupting the rotational motion of the paper feed roller, said second hub being fixed to one end of the second shaft, and a cam engaged with the second restricting means regulating transmission of the drive to the convey roller; and a solenoid controlling transmission of the drive to the paper feed roller, said solenoid having a plunger to be engaged with second stop to interrupt the rotational motion of the paper feed roller and a second elastic means for causing the plunger to return to an original unenergized state.

36. The paper feeding unit driving device as claimed in claim 35, said solenoid only controlling the turned-on or turned-off state of the paper feed roller while failing to control the turned-on or turned-off state of the convey roller.

37. The paper feeding unit driving device as claimed in claim 36, said plunger being moved downward to be separated from the second stop when said solenoid is energized, and said plunger returning to its original unenergized state by the second elastic means upon the solenoid being deenergized.

38. The paper feeding unit driving device as claimed in claim 35, wherein said first restricting means comprises a bracket to be engaged with said first stop.

39. The paper feeding unit driving device as claimed in claim 35, wherein said second restricting means comprises a bracket to be engaged with said cam.

40. The paper feeding unit driving device as claimed in claim 35, said first elastic means being a spring.

41. The paper feeding unit driving device as claimed in claim 40, said spring being a torsion spring.

42. The paper feeding unit driving device as claimed in claim 35, said first shaft having a D-cut end so as to be rotated according to the control of the first clutch-spring.

43. The paper feeding unit driving device as claimed in claim 35, said first linking means having a first opening into which a first projection, formed on one end of the first clutch-spring, is inserted to cause them to turn together.

44. The paper feeding unit driving device as claimed in claim 35, said first hub having a D-cut central portion so to be fixed to the first shaft.

45. The paper feeding unit driving device as claimed in claim 35, said first hub having a first opening on its inboard surface into which a second projection, formed on one end of the first clutch-spring, is inserted to cause them to turn together.

46. The paper feeding unit driving device as claimed in claim 35, said second shaft having a D-cut end so as to be rotated according to the control of the second clutch-spring.

47. The paper feeding unit driving device as claimed in claim 35, said second linking means having a second opening into which a second projection, formed on one end of the second clutch-spring, is inserted to cause them to turn together.

48. The paper feeding unit driving device as claimed in claim 35, said second hub having a D-cut central portion so to be fixed to the second shaft.

49. The paper feeding unit driving device as claimed in claim 35, said second linking means having a second opening on its inboard surface into which a second projection, formed on one end of the second clutch-spring, is inserted to cause them to turn together.

50. The paper feeding unit driving device as claimed in claim 35, said second elastic means being a spring.

51. The paper feeding unit driving device as claimed in claim 50, said spring being a tension spring.

* * * * *